US006898400B2

(12) United States Patent
Ehara

(10) Patent No.: US 6,898,400 B2
(45) Date of Patent: May 24, 2005

(54) DRIVE APPARATUS FOR A ROTARY MEMBER, AN IMAGE FORMING APPARATUS, AND A METHOD OF ASSEMBLY FOR A DRIVE APPARATUS

(75) Inventor: Yasuhisa Ehara, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/431,429

(22) Filed: May 8, 2003

(65) Prior Publication Data

US 2004/0009011 A1 Jan. 15, 2004

(30) Foreign Application Priority Data

Jul. 15, 2002 (JP) ..... 2002-205087
Apr. 10, 2003 (JP) ..... 2003-106441

(51) Int. Cl.[7] ..... G03G 15/00
(52) U.S. Cl. ..... 399/167
(58) Field of Search ..... 399/117, 167

(56) References Cited

U.S. PATENT DOCUMENTS 6,385,418 B1 * 5/2002 Fukuchi ..... 399/167

FOREIGN PATENT DOCUMENTS

| | | |
|---|---|---|
| EP | 0 886 075 | 12/1998 |
| GB | 214 120 | 4/1924 |
| JP | 2001-193755 | 7/2001 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A drive apparatus for a rotary member including a drive motor, and a drive shaft driven by the drive motor and having a first hole. The drive apparatus further includes a transmission member disposed around the drive shaft and configured to transmit the driving force to the rotary member by engaging with the rotary member. The transmission member includes a second hole extending in an axial direction of the drive shaft and being open toward a front side and closed toward a back side. A pin is inserted in the first and second holes. A spring presses the transmission member toward the rotary member.

16 Claims, 8 Drawing Sheets

DRIVE APPARATUS FOR A ROTARY MEMBER, AN IMAGE FORMING APPARATUS, AND A METHOD OF ASSEMBLY FOR A DRIVE APPARATUS

CROSS-REFERENCE TO RELATED APPLICATIONS

The present application claims priority to Japanese Patent Application No. 2002-205087 filed in the Japanese Patent Office on Jul. 15, 2002 and Japanese Patent Application No. 2003-106441 filed in the Japanese Patent Office on Apr. 10, 2003, the disclosures of which are hereby incorporated by reference herein in their entirety.

BACKGROUND OF THE INVENTION

1. Field of the Invention

The present invention relates to a drive apparatus for a rotary member, an image forming apparatus, such as a copying machine, a facsimile machine, a printer, or other similar image forming apparatus, and a method of assembly for a drive apparatus for a rotary member.

2. Discussion of the Background

A known drive apparatus for a rotary member is shown in FIG. 11. The drive apparatus includes a drive motor (not shown), a drive shaft 120 driven by the drive motor and a transmission member 134 for transmitting a driven force by the drive shaft 120. The transmission member 134 transmits the driven force to a rotary member (not shown). The transmission member 134 has a cylinder-shaped portion that is mounted around the drive shaft 120. The transmission member 134 has a long hole 145. The drive shaft 120 has a small hole 147 in which a regulation pin 144 is inserted. The regulation pin 144 also is inserted in the long hole 145 of the transmission member 134 so that the transmission member 134 cannot rotate relative to the drive shaft 120. However, the transmission member 134 can slide along the drive shaft 120 in the axial direction of the drive shaft 120 because the hole of the drive shaft 120 is long in the axial direction.

When the drive apparatus for the rotary member is used, an engaging part of the rotary member has to engage with an engaging part of the transmission member 134 in order for the driving force of the drive shaft 120 to transmit to the rotary member. Even if the engaging part of the rotary member does not engage with the engaging part of the transmission member, each the engaging parts can be engaged if the drive shaft is rotated.

When the drive apparatus for the rotary member is assembled, the regulation pin 144 is inserted into the holes 145, 147 while the holes are overlapped. If the holes 145, 147 are not overlapped precisely, the pin 144 damages an edge 145A of the long hole 145.

Japanese laid-open publication 2001-193755 describes a long hole having a width that is larger for a purpose of preventing the pin from damaging the edge of the long hole. If the width of the long hole is larger, however, the gap between the pin and the long hole is larger. As a result, the rotary member moves irregularly.

SUMMARY OF THE INVENTION

The present invention advantageously solves the above problem.

According to an aspect of the present invention, a drive apparatus for a rotary member is provided that includes a drive motor and a drive shaft configured to be driven by the drive motor and including a first hole. The drive apparatus also includes a transmission member configured to be disposed around the drive shaft and transmit the driving force to the rotary member by engaging with the rotary member. The transmission member includes a second hole extending in the direction of the axis of the drive shaft and being open toward a front side but being closed toward a back side. The drive apparatus further includes a pin configured to insert in the first and second holes, and a spring configured to press the transmission member toward the rotary member.

A more complete appreciation of the present invention and many of the attendant advantages thereof will be readily obtained as the same becomes better understood by reference to the following detailed description when considered in connection with the accompanying drawings.

DESCRIPTION OF THE PREFERRED EMBODIMENTS

Figure 1:
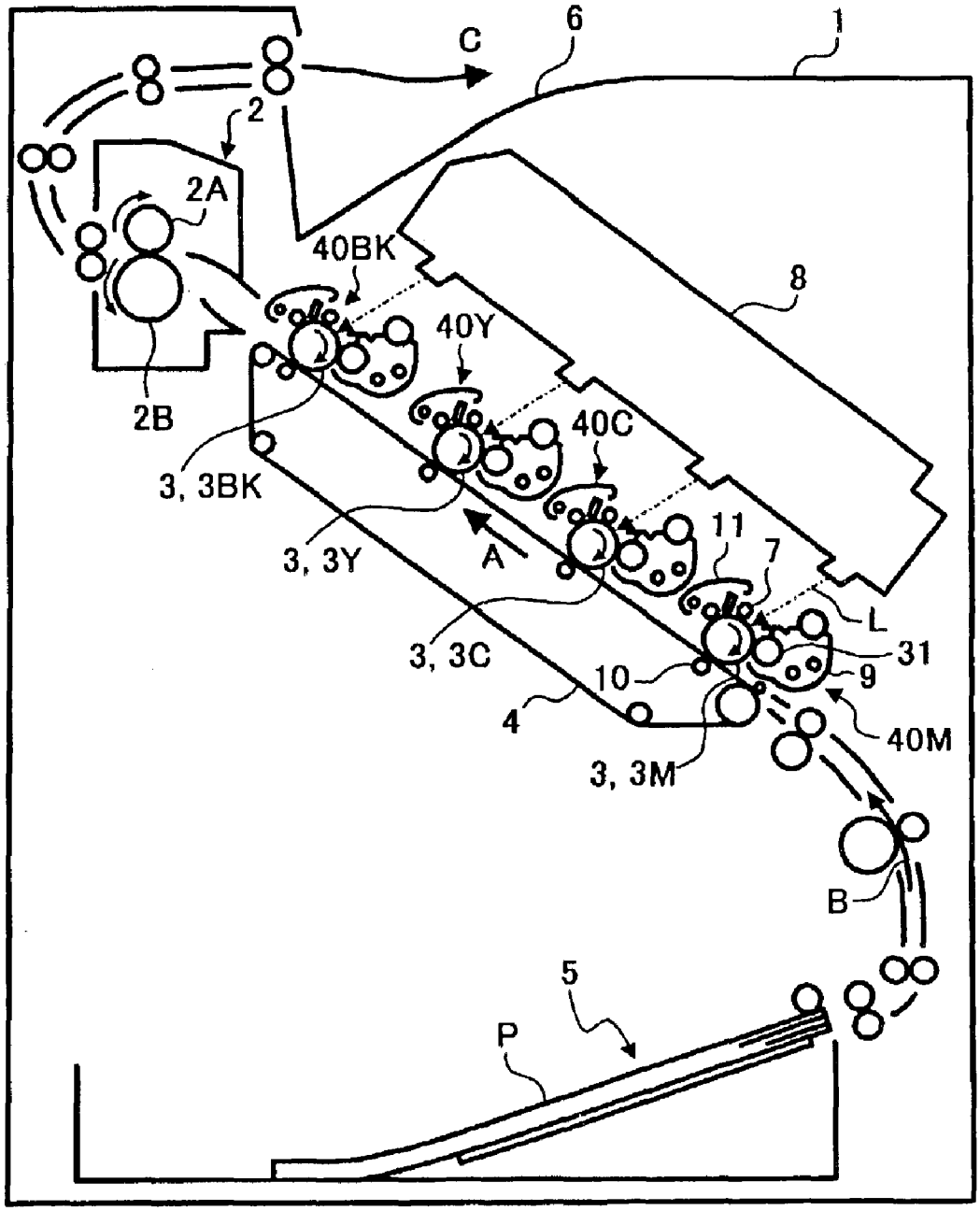
FIG. 1 is a schematic diagram showing an image forming apparatus.

Preferred embodiments of the present invention are described in detail with reference to the drawings, wherein like reference numerals designate identical or corresponding parts throughout the several views.

FIG. 1 is a schematic diagram showing an image forming apparatus including a drive apparatus for a rotary member. The image forming apparatus includes four photo conductor drums 3 as rotary members (image carriers) in a main body 1. Each photo conductor drum 3 is formed from a metal body and a photo conductor layer on the metal body and is rotated by the drive apparatus. The photo conductor 3BK can keep black toner. The photo conductor 3Y can keep yellow toner. The photo conductor 3C can keep cyan toner. The photo conductor 3M can keep magenta toner. Each photo conductor 3BK, 3Y, 3C, 3M is opposite to a conveyance belt 4. The conveyance belt 4 is stretched by rollers and rotates in the direction of the arrow A.

The method for forming an image toner on the photo conductor 3M is the same as those of the photo conductors 3C, 3Y, 3BK, so only photo conductor 3M is described below.

The photo conductor 3M rotates in a clockwise direction. A charging roller 7 provides a charge on the photo conductor 3M and then a writing unit emits the laser light to the photo conductor 3M. After that, the latent image is formed on the photo conductor 3M. A developing roller 31 of a developing device 9 provides the magenta toner with the latent image on the photo conductor 3M.

A sheet feed part 5 is disposed in the lower part of the main body 1. The sheet feed part 5 feeds a sheet P in the direction of the arrow B. The sheet P is conveyed between the conveyance belt 4 and the photo conductor 3M. The magenta image on the photo conductor 3M is transferred to the sheet P by a transfer roller 10. A cleaning device 11 collects the remaining toner not transferred to the sheet P.

The method for transferring the image to the sheet from the photo conductors 3C, 3Y, 3BK are the same as the method for transferring the image from conductor 3M. Once the sheet P receives the image from the photo conductors 3M, 3C, 3Y, 3BK then the sheet P moves to a fixing device 2, and then fixing rollers 2A, 2B of the fixing device 2 fix the image on the sheet P.

In this embodiment, each process cartridge 40Y, 40M, 40C, 40BK includes a respective photo conductor 3Y, 3M, 3C, 3BK, charging roller, developing device, and cleaning device respectively. Each process cartridge is detachable from the main body 1. The developing device and the cleaning device are provided within a casing of the process cartridge.

Figure 2:
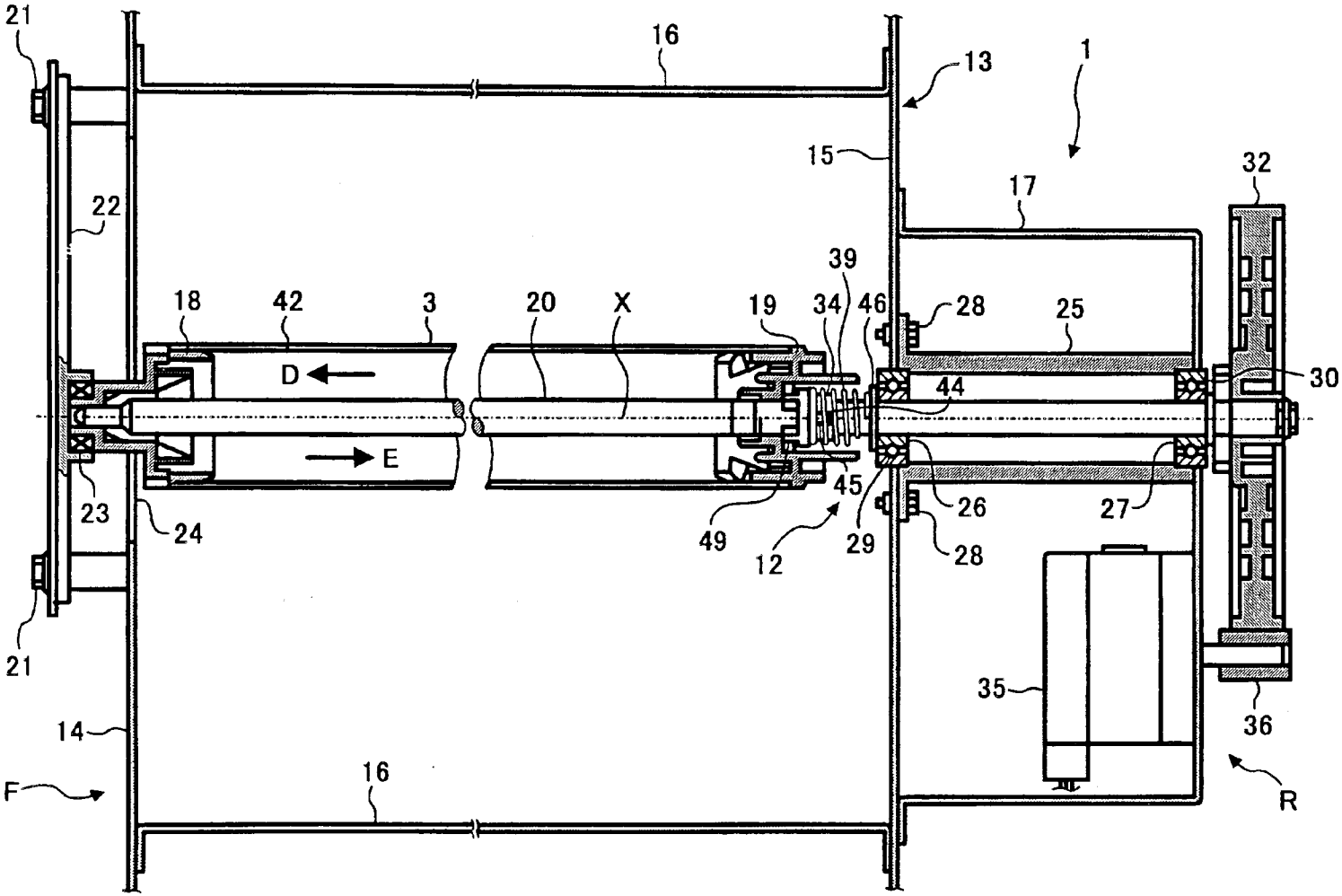
FIG. 2 is a cross-sectional diagram showing a photo conductor of a process cartridge and a drive apparatus for a photo conductor.

FIG. 2 is a cross-sectional diagram showing the photo conductor 3 of the process cartridge and the drive apparatus for the photo conductor. As shown in FIG. 2, the photo conductor 3 includes a drum body 42, a front flange 18, and a rear flange 19. The front flange 18 and the rear flange 19 are supported in holes formed on the casing of the process cartridge. Reference character F means front, and reference character R means a rear.

A main frame 13 of the main body 1 includes a front plate 14, a rear plate 15, a stay 16 connecting the front plate 14 and the rear plate 15, and a bracket 17 fixed in the rear plate 15. The drive apparatus for the rotary member 12 includes a drive shaft 20. The front flange 18 and the rear flange 19 are disposed around the drive shaft 20

A positioning plate 22 is fixed in the front plate 14 by plural screws 21. The positioning plate 22 rotationally supports the front flange 18 through a bearing 23. In this way, the front part of the photo conductor 3 is positioned in the radial direction. The front flange 18 and the front part of the drive shaft 20 inserts in a hole 24 of the front plate 14.

On the other hand, the bracket 17 rotationally supports the rear part of the drive shaft 20 through bearings 26, 27. These bearings 26, 27 are supported by an inner part of a holder 25. The holder 25 is fixed in the bracket 17 by plural screws 28. In this way, the rear part of the drive shaft 20 is positioned in the radial direction.

When the screws 21 are removed from the positioning plate 22, the positioning plate 22 is also removed from the front plate 14. After that, the photo conductor 3 is pulled out together with the other component of the process cartridge in the direction of the arrow D. Specifically, the front flange 18 and the rear flange 19 with the photo conductor 3 are removed from the drive shaft 20 through the hole 24 of the front plate 14.

Figure 3:
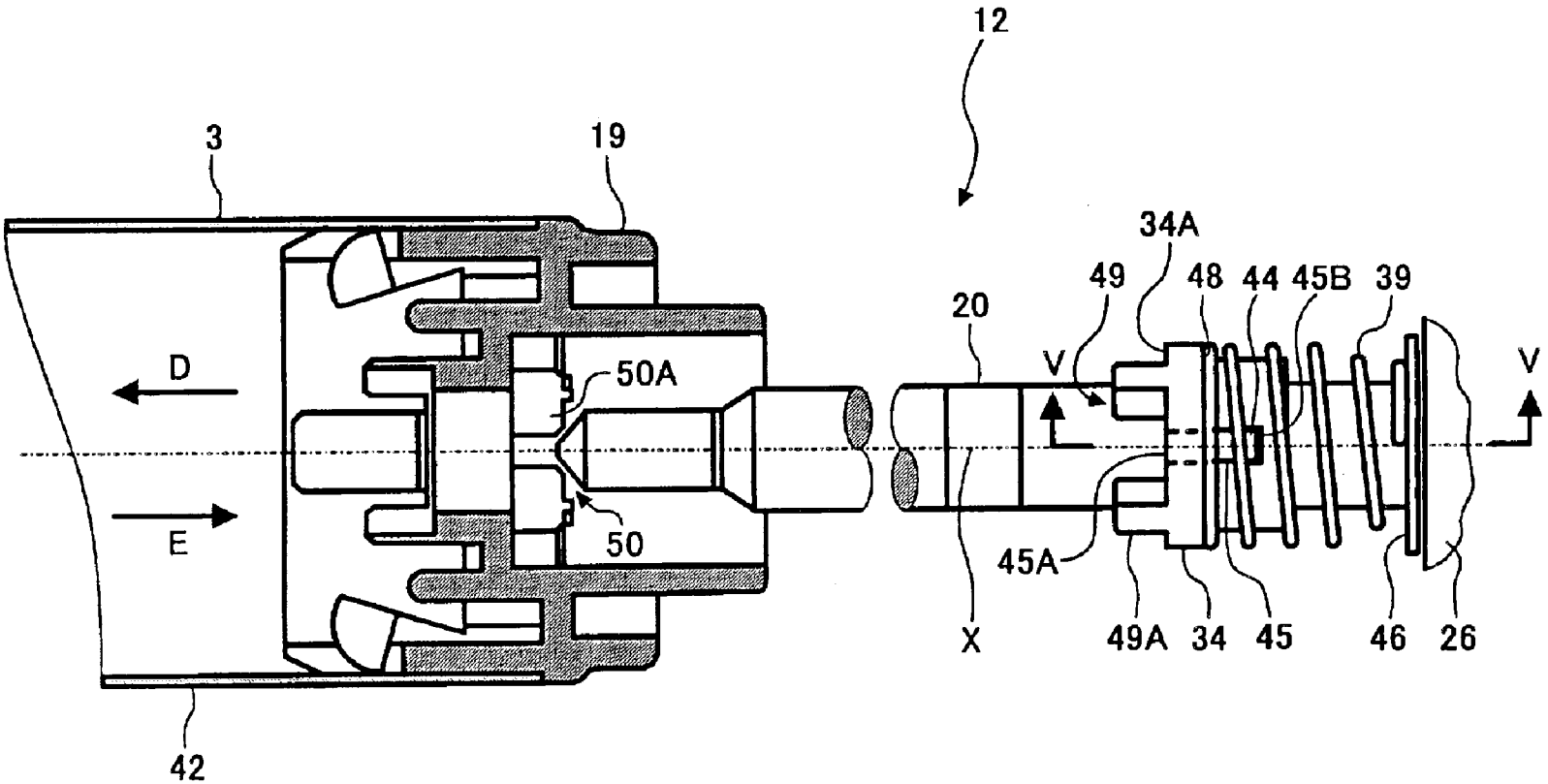
FIG. 3 is a diagram explaining an assembly method of the photo conductor and the drive apparatus.

FIG. 3 is a diagram explaining an assembly method of the photo conductor and the drive apparatus. When the photo conductor 3 moves toward the drive shaft 20 in the direction of the arrow E, these parts are engaged. On the other hand, the photo conductor 3 moves in the direction of the arrow D, these parts are disengaged.

As shown in FIG. 2, the drive apparatus for the rotary member 12 includes the shaft 20, a drive motor 35 driving the drive shaft 20, a transmission member 34 for transmitting a driven force by the driven shaft 20, a spring 39 disposed around the drive shaft 20, a stopper 46 and a regulation pin 44. The bracket 17 supports the drive motor 35, and a gear 36 of the drive motor 35 is engaged in an output gear 32 of the drive shaft 20. In this way, the driving force of the drive motor 35 is transmitted to the photo conductor 3. Instead of the gear 32, a pulley may be used.

Figure 4:
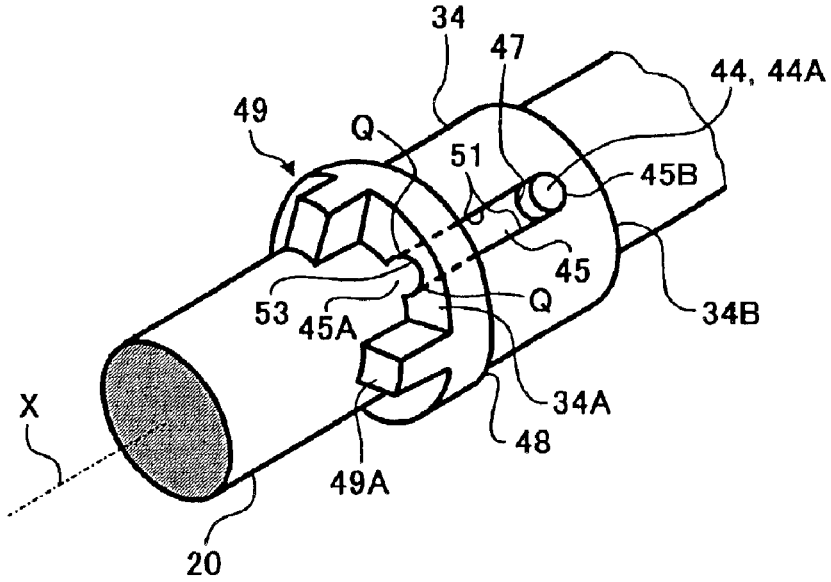
FIG. 4 is a perspective diagram showing the drive shaft and the transmission member.
Figure 5:
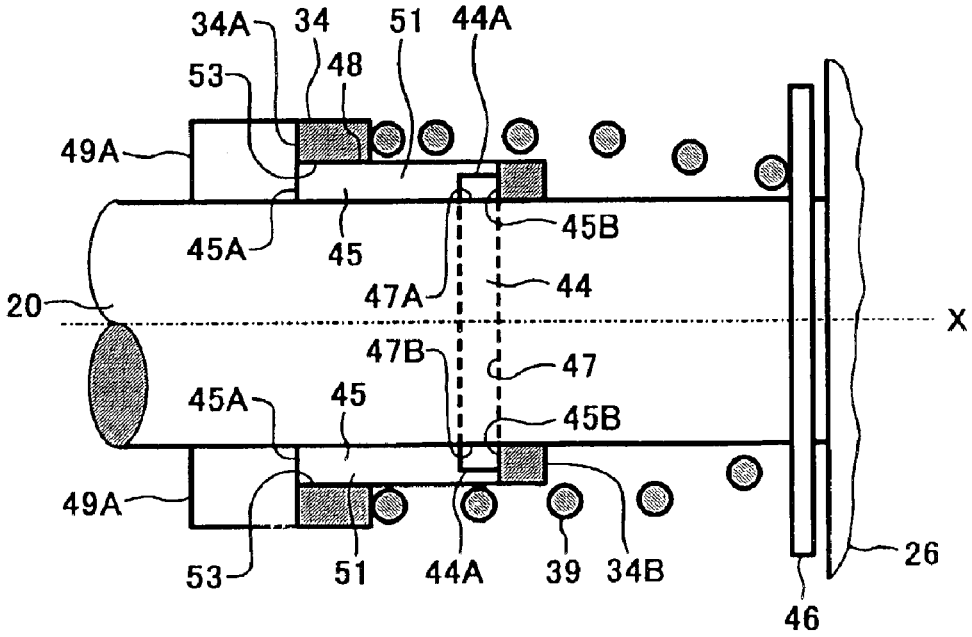
FIG. 5 is a cross-sectional diagram of FIG. 4.

FIG. 4 is a perspective diagram showing the drive shaft 20 and the transmission member 34. FIG. 5 is a cross-sectional diagram of FIG. 4.

As shown in FIGS. 3–5, the transmission member 34 has a cylinder-shaped portion. The transmission member 34 includes two long holes 45. The drive shaft 20 includes a hole 47. The regulation pin 44 is inserted in the hole 47 and is fixed in the drive shaft 20. Both of edges 44A of the regulation pin 44 project from the surface of the drive shaft 20. The edges 44A are engaged in the long holes 45 of the transmission member 34. In this way, the transmission member 34 can move in the axial direction X, but cannot move in the radial direction.

The stopper 46 is disposed around the drive shaft 20, and has a ring-shaped portion. The spring 39 is disposed between the stopper 46 and a support part 48 of the transmission member 34.

The transmission member 34 further includes plural projection parts. An engaging part 49 of driving side includes the plural projection parts 49A. On the other hand, as shown in FIG. 3, the rear flange 19 includes plural concave parts 50A. An engaging part of driven side 50 includes the plural concave parts. As shown in FIG. 2, the engaging part of driving side 49 is engaged with the engaging part of driven side 50 by the spring 39. When the drive motor 35 drives, the output of the drive motor 35 rotates the gear 36, which is engaged with the output gear 32. Then, the drive shaft 20 rotates with the gear 32. Then, the rotation of the drive shaft 20 drives the transmission member 34 through the regulation pin 44. After that, the rotation of the transmission member 34 transfers to the rear flange 19 because the engaging part of driving side 49 is engaged with the engaging part of driven side 50. In this way, the photo conductor 3 can rotate.

As shown in FIG. 2, when the photo conductor 3 is moved outward in the direction of the arrow D, the engaging part of driving side 49 is disengaged from the engaging part of driven side 50. On the other hand, when the photo conductor 3 is moved in the direction of the arrow E, the engaging part of driving side 49 engages with the engaging part of driven side 50.

Further, if the engaging part of driving side 49 is disengaged from the engaging part of driven side 50 when the photo conductor 3 moves in the direction of the arrow E, then the engaging part of driving side 49 can engage with the engaging part of driven side 50 because the spring 39 can be compressed.

The transmission member 34 further includes a front face 34A and a rear face 34B. The long hole 45 extends from the front face 34A to the rear face 34B. The front side of the long hole 45 is open along the axial direction. On the other hand, the rear side of the long hole 45 is closed along the axial direction. As shown in FIG. 3, the edge of the long hole 45B receives the regulation pin 44.

Figure 6:
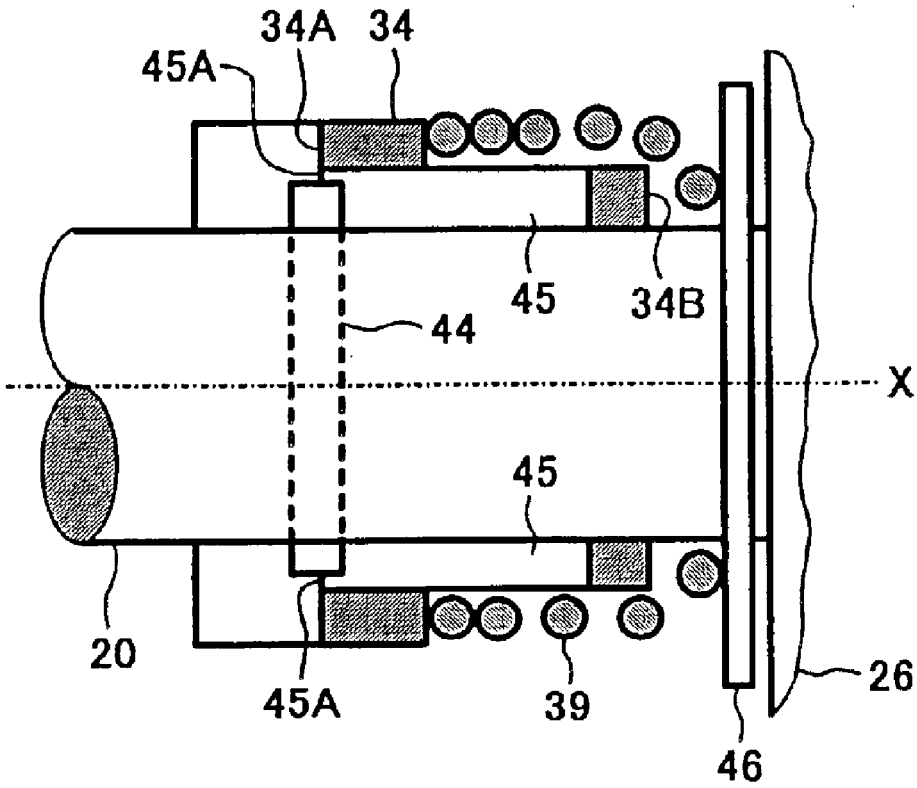
FIG. 6 is a diagram showing a spring in a compressed state.

FIG. 6 is a diagram showing the spring 39 in a compressed state. In this situation, the regulation pin 44 is held within the long hole 45 by the stopper 46. Therefore, the regulation pin 44 remains within the long hole 45 even though the front side of the long hole 45 is open.

Figure 7:
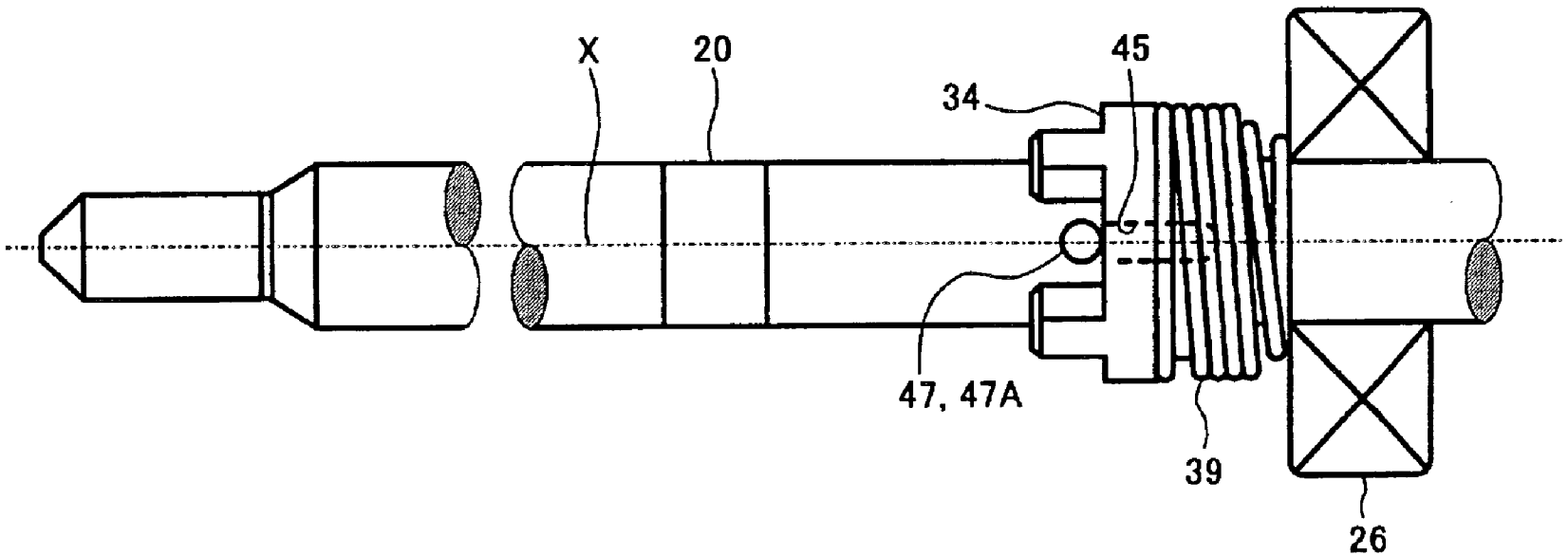
FIG. 7 is a diagram explaining the first assembly method for the drive apparatus.

The assembly method for the drive apparatus is described below. Firstly, as shown in FIG. 7, the spring 39 and the transmission member 34 are installed on the drive shaft 20. Secondly, the spring 39 is compressed such that the hole 47 is open. In this orientation, the hole 47 does not overlap the long hole 45. Reference number 47A is an entrance of the hole 47 and reference number 47B is an exit of the hole 47. Thirdly, the regulation pin 44 is inserted in the hole 47 from the entrance 47A. In this way, the regulation pin 44 is fixed in the drive shaft 20, and both of edges 44A of the regulation pin 44 project from the surface of the drive shaft 20. Fourthly, both of edges 44A match in alignment to the front side 45A of the long hole 45. Fifthly, after the transmission member 34 moves apart from the bearing 26, the regulation pin 44 can be inserted in the long hole 45. Sixthly, the stopper 46 is engaged between the bearing 26 and the spring 39.

Figure 8:
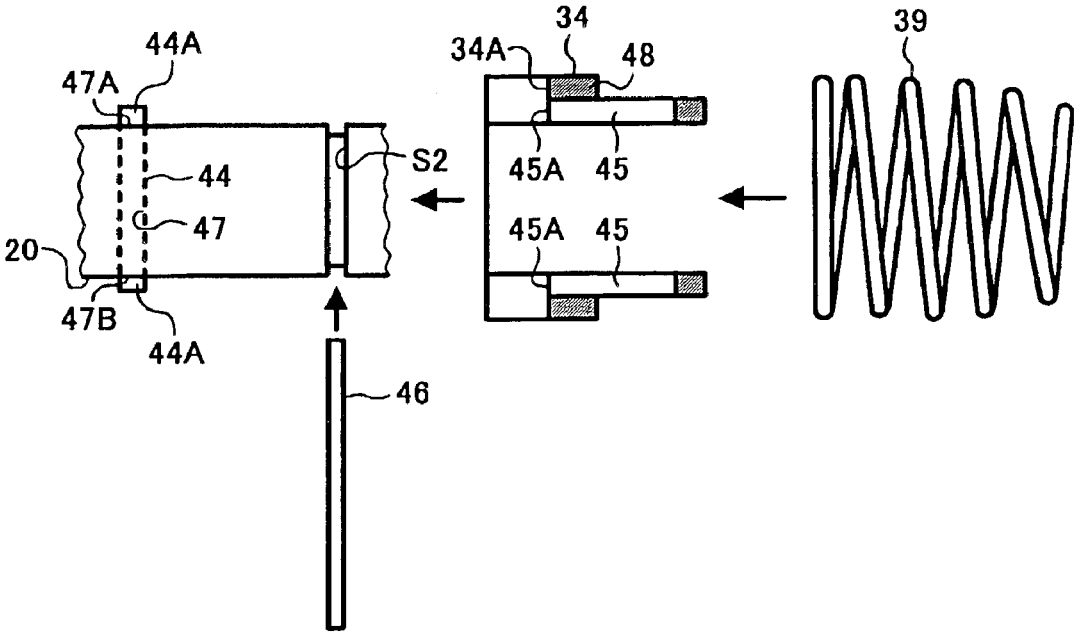
FIG. 8 is a diagram explaining the second assembly method for the drive apparatus.

As depicted in FIG. 8, if the bearing 26 is not present, then the regulation pin 44 can be inserted in the hole 47 at first. Then, the transmission member 34 and the spring 39 are installed around the drive shaft 20. After that, the stopper 46 is fixed to the drive shaft 20.

Therefore, the hole 47 and the long hole 45 need not be overlapped when the regulation pin 44 is inserted so that the regulation pin 44 does not damage the long hole 45. As a consequence, the width of the long hole need not be larger, and the photo conductor can move regularly.

Figure 11:
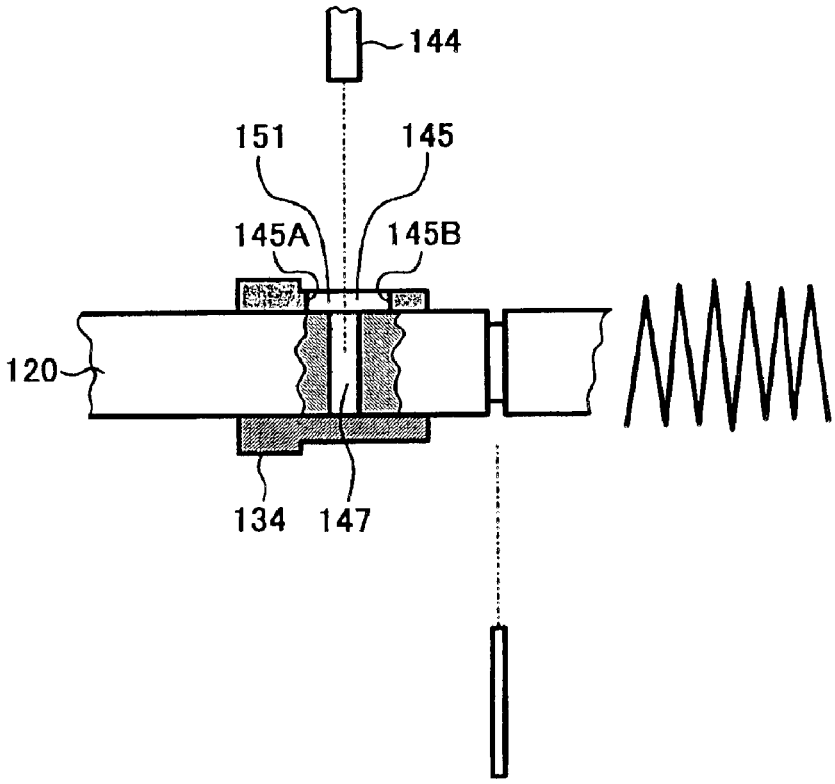
FIG. 11 RELATED ART
FIG. 11 is a cross-sectional diagram showing the part of the drive apparatus for the rotary member.

In order to manufacture the transmission member precisely, well known methods such as powder metallurgy are used. However, because the long hole 145 as shown in FIG. 11 is not open in the direction of the axis, the transmission member cannot be removed from the mold if it includes the long hole 145. Therefore, the transmission member is manufactured by powder metallurgy except for the long hole, and then the long hole is manufactured by a machinery work. As a consequence, the related art transmission member requires two manufacturing processes. Such processes are costly and suffer from a problem that the long hole cannot be formed precisely.

On the other hand, the transmission member 34 of the present can be manufactured using only one process by using powder metallurgy because the front side of the long hole 45 is open such that the transmission member 34 can be removed from the mold. Therefore, the manufacturing cost can be reduced and the long hole can be manufactured precisely. Further, as shown in FIG. 4, the engaging part 49 does not correspond to the location of the long hole 47 in order to keep the strength of the engaging part 49.

Figure 9:
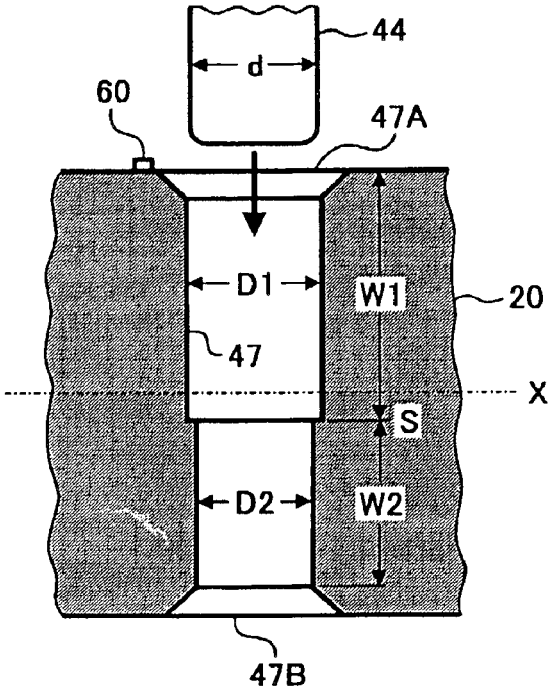
FIG. 9 is a cross-sectional diagram showing a hole and a regulation pin.

As shown in FIG. 9, both of the entrance 47A and the exit 47B may be formed as with a taper in order that the regulation pin 44 can be inserted in the hole 47 easily. Further, the diameter (D1) of W1 may be bigger than the diameter (D2) of W2 in order that the regulation pin 44 can be guided in the portion of the D1 and then the regulation pin 44 can be fixed in the portion of the D2.

Figure 10:
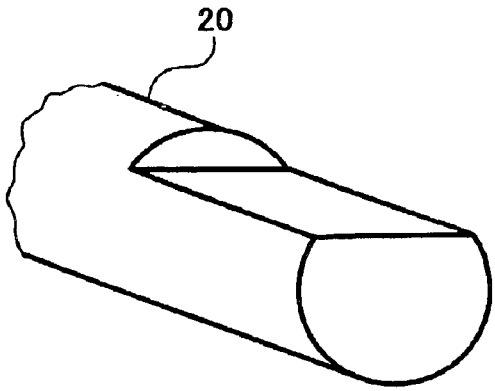
FIG. 10 is a perspective diagram showing an edge of the drive shaft.

However, it is possible that the regulation pin 44 may be inserted in the exit 47B first. Therefore, when the person inserts the regulation pin 44 in the hole 47, a mark 60 may be disposed near the entrance 47A. On the other hand, when the machine inserts the regulation pin 44 in the hole 47, the edge of the drive shaft 20 may be formed or cut in the shape of a portion of the character D as shown in FIG. 10. If the machine holds the edge of the drive shaft 20, the entrance 47A is oriented upward.

Further, as shown in FIG. 4 and FIG. 5, a part 51 of the long hole 45 penetrates through the transmission member 34, but the whole long hole 45 is not penetrated because a part 53 has a bottom surface. Such a bottom surface may be disposed along the entire length of the long hole 45. In this case, the transition part Q between the part 51 and the part 53 may be formed in the curve portion in order to prevent the stress concentration.

Furthermore, a spring pin or a parallel pin may be used as the regulation pin 44. Either pin may have more than HV 470 hardness in order to prevent the deformation of the pin. Specifically, the parallel pin may be better than another pin.

The drum-shaped photo conductor 3 was described as one example of a rotary member, but the drive apparatus of this invention may apply to the transfer roller 10, the developing roller 31, the fixing rollers 2A, 2B, a support roller supporting the conveyance belt 4, a conveyance roller, a belt-shaped photo conductor, or a support roller supporting an intermediate transfer belt. Further, the invention may apply to a drive apparatus a device other than an image forming apparatus.

It will be apparent to those having skill in the art that many changes may be made in the above-described details of the preferred embodiments of the present invention. The scope of the present invention, therefore, should be determined by the following claims.

What is claimed:

1. A drive apparatus for a rotary member comprising:

a drive motor;

a drive shaft configured to be driven by the drive motor, the drive shaft having a first hole;

a transmission member disposed around the drive shaft, the transmission member being configured to transmit the driving force to the rotary member by engaging with the rotary member, the transmission member including a second hole extending in an axial direction of the drive shaft, the second hole being open toward a front side and closed toward a back side;

a pin inserted in the first and second holes; and a spring configured to press the transmission member toward the rotary member.

2. A drive apparatus according to claim 1, further comprising:

a stopper disposed between the spring and a bearing adapted to support the drive shaft, wherein the stopper holds the pin within the second hole.

3. A drive apparatus according to claim 1, wherein:

the transmission member further includes plural engaging parts engaged with the rotary member; and the second hole is disposed between the plural engaging parts.

4. A drive apparatus according to claim 1, wherein the first hole includes a first part and a second part, the second part having a greater width than the first part.

5. A drive apparatus according to claim 4, further comprising a mark disposed near an entrance of the first hole.

6. A drive apparatus according to claim 1, wherein:

the second hole includes a first part and a second part; and a transition part between the first part and the second part is a curve-shaped portion.

7. A drive apparatus according to claim 1, wherein the pin has a hardness of more than HV 470.

8. An image forming apparatus comprising:

an image carrier configured to rotate the image carrier having a surface configured to carry an image;

a drive motor configured to drive the image carrier;

a drive shaft configured to be driven the drive motor, the drive shaft having a first hole;

a transmission member disposed around the drive shaft, and the transmission member being configured to transmit the driving force to the rotary member by engaging with the rotary member, the transmission member including a second hole extending in an axial direction of the drive shaft, the second hole being open toward a front side and closed toward a back side;

a pin inserted in the first and second holes; and a spring configured to press the transmission member toward the image carrier.

9. An image forming apparatus according to claim 8, further comprising:

a stopper disposed around the drive shaft and configured to support the spring, wherein the stopper holds the pin within the second hole.

10. An image forming apparatus according to claim 8, wherein:

the transmission member further includes plural engaging parts engaged with the rotary member, and the second hole is disposed between the plural engaging parts.

11. An image forming apparatus according to claim 8, wherein the first hole includes a first part and a second part, the second part having a greater width than the first part.

12. An image forming apparatus according to claim 11, further comprising a mark disposed near an entrance of the first hole.

13. An image forming apparatus according to claim 8, wherein:

the second hole includes a first part and a second part; and a transition part between the first part and the second part is a curve-shaped portion.

14. An image forming apparatus according to claim 8, wherein the pin has a hardness of more than HV 470.

15. A method of assembly for a drive apparatus, the drive apparatus including:

a drive motor;

a drive shaft configured to be driven by the drive motor, the drive shaft having a first hole;

a transmission member disposed around the drive shaft, the transmission member being configured to transmit the driving force to the rotary member by engaging with the rotary member, the transmission member including a second hole extending in an axial direction of the drive shaft, the second hole being open toward a front side and closed toward a back side;

a pin configured to be inserted in the first and second holes; and a spring configured to press the transmission member toward the rotary member;

said method comprising the steps of:

installing the spring and the transmission to the drive shaft;

keeping the first hole open;

inserting the pin in the first hole;

fixing the pin to the drive shaft;

matching the front side of the second hole to the first hole; and inserting the pin into the second hole.

16. A method of assembly for a drive apparatus, the drive apparatus including:

a drive motor;

a drive shaft configured to be driven by the drive motor, the drive shaft having a first hole;

a transmission member disposed around the drive shaft, the transmission member being configured to transmit the driving force to the rotary member by engaging with the rotary member, the transmission member including a second hole extending in an axial direction of the drive shaft, the second hole being open toward a front side and closed toward a back side;

a pin configured to be inserted in the first and second holes;

a spring configured to press the transmission member toward the rotary member; and a stopper configured to be disposed between the spring and a bearing disposed in the drive shaft;

said method comprising the steps of:

installing the spring and the transmission to the drive shaft;

compressing the spring;

keeping the first hole open;

inserting the pin in the first hole;

fixing the pin to the drive shaft;

matching the front side of the second hole to the first hole;

inserting the pin into the second hole; and engaging the stopper between the spring and the bearing.

* * * * *